US009552949B2

(12) United States Patent
Fischer

(10) Patent No.: US 9,552,949 B2
(45) Date of Patent: Jan. 24, 2017

(54) CIRCUIT BREAKER AND ADAPTER FOR A CIRCUIT BREAKER

(71) Applicant: ELLENBERGER & POENSGEN GMBH, Altdorf (DE)

(72) Inventor: Erich Fischer, Altdorf (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 0 days.

(21) Appl. No.: 14/739,523

(22) Filed: Jun. 15, 2015

(65) Prior Publication Data

US 2015/0287563 A1 Oct. 8, 2015

Related U.S. Application Data

(63) Continuation of application No. PCT/EP2013/003492, filed on Nov. 19, 2013.

(30) Foreign Application Priority Data

Dec. 15, 2012 (DE) ..... 10 2012 024 608

(51) Int. Cl.

| | |
|---|---|
| ***H01H 51/00*** | (2006.01) |
| ***H01H 71/08*** | (2006.01) |
| ***H01H 73/20*** | (2006.01) |
| ***H01H 73/30*** | (2006.01) |
| ***H01H 71/02*** | (2006.01) |
| ***H01H 71/16*** | (2006.01) |
| ***H01H 71/24*** | (2006.01) |

(Continued)

(52) U.S. Cl.

CPC ..... *H01H 71/08* (2013.01); *H01H 71/02* (2013.01); *H01H 71/16* (2013.01); *H01H 71/24* (2013.01); *H01H 73/20* (2013.01); *H01H 73/30* (2013.01); *H01H 85/0418* (2013.01); *H01H 2085/207* (2013.01)

(58) Field of Classification Search

CPC ..... H01H 71/08; H01H 71/02; H01H 71/16; H01H 71/24

USPC ..... 335/145

See application file for complete search history.

(56) References Cited

U.S. PATENT DOCUMENTS

| | | | |
|---|---|---|---|
| 1,359,298 | A | 11/1920 | Wadsworth et al. |
| 1,614,223 | A | 1/1927 | Aichele |

(Continued)

FOREIGN PATENT DOCUMENTS

| | | | |
|---|---|---|---|
| CN | 102449720 | A | 5/2012 |
| DE | 458967 | C | 4/1928 |

(Continued)

*Primary Examiner* — Shawki S Ismail
*Assistant Examiner* — Lisa Homza
(74) *Attorney, Agent, or Firm* — Laurence A. Greenberg; Werner H. Stemer; Ralph E. Locher

(57) ABSTRACT

A circuit breaker for protecting an electric circuit contains a housing and an adapter having a receiving connector. The circuit breaker has two electrically conductive, substantially cylinder-shaped connection points which are positioned along an axis. Either the outer diameter of the connection points is between 5.0 mm and 5.3 mm and the maximum distance between the connection points is between 19.0 mm and 21.0 mm, or the outer diameter of the connection points is between 6.2 mm and 6.5 mm and the maximum distance between the connection points is between 30.5 mm and 33.0 mm.

9 Claims, 3 Drawing Sheets

(51) Int. Cl.
*H01H 85/041* (2006.01)
*H01H 85/20* (2006.01)

(56) References Cited

U.S. PATENT DOCUMENTS 2,416,358 A * 2/1947 Stilwell, Jr. ..... H01H 50/20 200/241
2,458,804 A 1/1949 Sundt
2,474,762 A * 6/1949 Sundt ..... H01H 73/30 337/113
2,713,098 A * 7/1955 Swain ..... H01H 85/143 337/161
3,046,371 A * 7/1962 Jencks ..... H01H 71/525 335/145
3,265,835 A * 8/1966 Wood ..... H01H 73/30 335/145
4,635,021 A 1/1987 Hsieh
5,471,185 A * 11/1995 Shea ..... H01H 29/004 200/211
5,565,828 A * 10/1996 Flohr ..... H01H 71/40 218/1
5,894,259 A * 4/1999 Kolberg ..... H01H 71/121 335/10
5,951,328 A * 9/1999 Roper, Jr. ..... H01H 85/2035 439/620.27
6,590,489 B1 * 7/2003 Ullermann ..... H01H 9/32 337/112
7,336,149 B2 2/2008 Ullermann
8,373,523 B2 2/2013 Valdemarsson

FOREIGN PATENT DOCUMENTS

| | | | |
|---|---|---|---|
| DE | 3437802 | A1 | 4/1986 |
| DE | 3610451 | A1 | 10/1987 |
| DE | 9110399 | U1 | 12/1991 |
| DE | 19856707 | A1 | 6/2000 |
| DE | 202004008338 | U1 | 10/2005 |
| JP | S57163939 | A | 10/1982 |
| JP | 2002532826 | A | 10/2002 |
| WO | 2005041239 | A1 | 5/2005 |

* cited by examiner

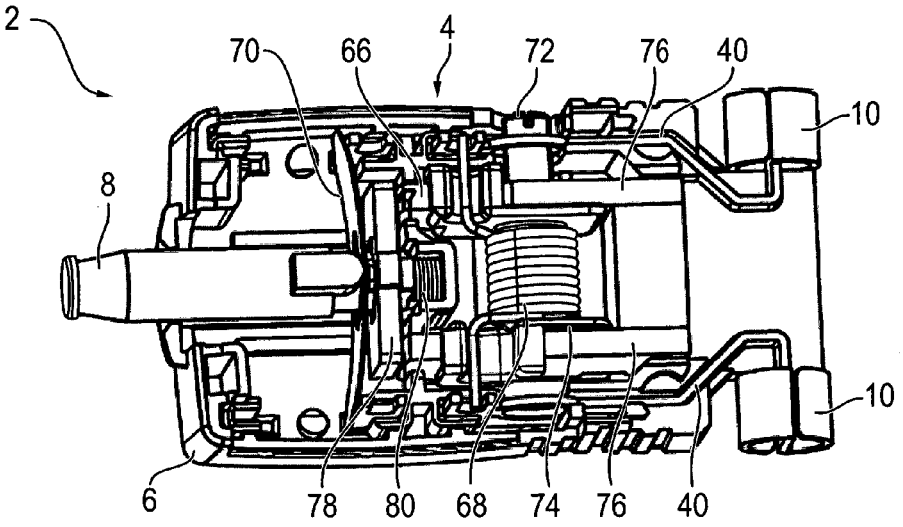
FIG. 4
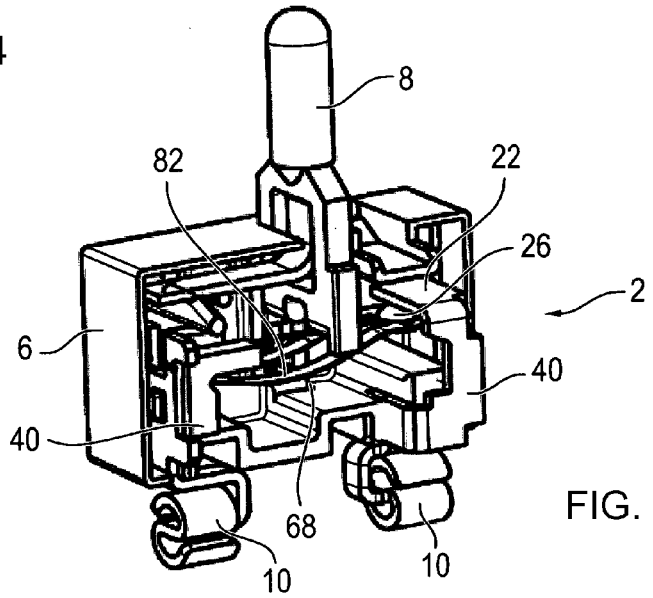
FIG. 5
FIG. 6
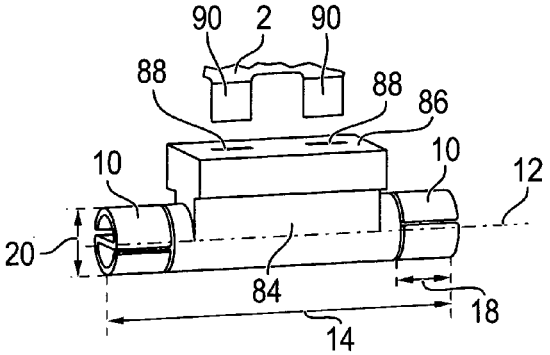

CIRCUIT BREAKER AND ADAPTER FOR A CIRCUIT BREAKER

CROSS-REFERENCE TO RELATED APPLICATION

This is a continuation application, under 35 U.S.C. §120, of copending international application No. PCT/EP2013/003492, filed Nov. 19, 2013, which designated the United States; this application also claims the priority, under 35 U.S.C. §119, of German patent application No. DE 10 2012 024 608.2, filed Dec. 15, 2012; the prior applications are herewith incorporated by reference in their entireties.

BACKGROUND OF THE INVENTION

Field of the Invention

The invention relates to a circuit breaker and an adaptor for a circuit breaker.

Electrical devices, for instance switched-mode power supplies or switchgear cabinets in machinery and plant engineering, are protected against an overcurrent by so-called G fuse-links, wherein the fuses are configured as blowable fuses. In this connection, very quick-acting fuse-links, quick-acting fuse-links, medium fuse-links, time-delay fuse-links and long time-delay fuse-links, which differ in terms of their blow characteristics, are distinguished. Thus, quick-acting fuse-links already blow in the case of comparatively short current spikes, whereas time-delay fuse-links only respond in the case of an overcurrent which endures for a comparatively long time in order, for example, to enable the start-up of an electric motor and a current spike caused thereby without interrupting the circuit.

Once the fuse has blown, it must be exchanged and replaced with a new one in order to enable a flow of current in the protected circuit once again. Usually, an undamaged fuse of this type is not available, as a result of which an unsuitable fuse-link is often used. Thus, for example, a time-delay fuse is used instead of a quick-acting fuse, which causes only an insufficient renewed protection of the circuit. If a fuse of this type should also not be present, protective disconnection by the fuse leads to a standstill of any electric machines present in the circuit for a comparatively long period of time. Alternatively, the fuse is short-circuited by a wire or the like, wherein, in the event of such an approach, the circuit is essentially no longer protected.

An alternative to this is the use of a circuit breaker. For this purpose, in already existing electrical machines or circuits, the mounting for the fuse-link must be removed and replaced with a mounting for the circuit breaker. Usually, there is not sufficient space for such structural interference or the conductor tracks of any printed circuit board which is attached to the fuse mounting do not correspond to the inclusion of the circuit breaker mounting. In addition, in the case of such structural interference, further components of the circuit may be damaged or any warranty claim to the manufacturer of the electrical machine may be forfeited.

SUMMARY OF THE INVENTION

The invention is based on the problem of increasing the operational reliability of a circuit protected by a G fuse-link, and in particular of simplifying restarting after protective disconnection.

The circuit is protected by a circuit breaker having a housing. The circuit breaker contains two electrically conductive connection points which are configured to be substantially cylindrical and between which, in particular, a mechanism for protecting the circuit is arranged. The axes of the two cylindrically configured connection points are on a common straight line and the two connection points are preferably configured to be substantially identical. In this case, the external diameter of each of the connection points is between 5.0 mm and 5.3 mm in size and the maximum distance between the connection points, that is to say the distance between the two limit surfaces of the two connection points, which limit surfaces face away from one another and in each case form a cover surface of the cylindrical shape, is between 19.0 mm and 21.0 mm. In a suitable manner, the external diameter is precisely 5.2 mm, wherein a downward deviation of as much as 0.2 mm and an upward deviation of up to 0.1 mm are tolerated. The maximum distance is preferably 20.0 mm with a tolerated deviation of up to 0.5 mm in accordance with European Standard EN 60127 for fuse-links. By such a selection of the geometric dimensions of the connection points, it is made possible to insert the circuit breaker into a G fuse-link mounting and to protect the circuit by the circuit breaker. In this case, no structural modifications to the fuse mounting have to be performed.

As an alternative to this, the external diameter of each of the connection points is between 6.2 mm and 6.5 mm, wherein the external diameter is preferably precisely 6.35 mm with a tolerance of up to 0.1 mm. In the case of this external diameter, the maximum distance between the connection points is between 30.5 mm and 33.0 mm. Expediently, the maximum distance is 31.8 mm with a tolerance of up to 0.8 mm.

Expediently, the height of each of the connection points, that is to say the extent of the connection point along the respective axis, is between 4.0 mm and 6.0 mm, provided that the external diameter is substantially around 5.2 mm. Preferably, the height is precisely 5.1 mm with a tolerance of 0.6 mm. In the case of the enlarged external diameter, the height is equal to a value between 5.5 mm and 7.0 mm. In particular, the height is 6.2 mm with a tolerance of 0.6 mm. By means of such a selection of the dimensions of the height in connection with the respective external diameter and the maximum distance, conformity with European Standard EN 60127 is ensured, and the circuit breaker can be integrated in an already existing circuit without it being necessary to perform structural modifications, as a result of which, for example, a short circuit between the connection point and other components of the circuit is avoided.

The connection points consist, by way of example, of a solid material or are shaped in the manner of a hollow cylinder with a preferably substantially circular cross section. However, it is particularly preferable for the connection points to be made from a metal strip which has a substantially S-shaped cross section perpendicular to the direction of extent of the cylindrical connection point. By way of example, the connection point consists of a metal strip with a width of substantially 5.1 mm and a length of between 21.0 and 23.0 mm, which is bent into the S-shape, wherein the dimensions apply to the smaller of the two external diameters. wing to a configuration such as this of the respective connection point, it is made possible to manufacture the connection point as a comparatively cost-effective punched and bent part, which is preferably the case. Here, a comparatively efficient electrically conductive connection of the connection points to any mounting which is present is ensured.

In a suitable manner, the circuit breaker is reversibly trippable. In other words, the circuit breaker is set up such that, after tripping and subsequent interruption of the flow of current through the circuit, it is possible to reset the circuit breaker into the conductive state, that is to say into the state before the interruption of current. By way of example, the circuit breaker contains a breaker latching mechanism which trips within the circuit in the case of a predefined current value and/or voltage value and thus interrupts the flow of current within the circuit. Owing to the reversible tripping of the circuit breaker, it is not necessary to keep spare parts in stock in order to ensure a flow of current again after correction of the circumstance which leads to the interruption.

In particular, once the circuit breaker has tripped, transfer of the circuit breaker from the non-conductive state into the conductive state is blocked by a slider in order to avoid uncontrolled renewal of the flow of current. Preferably, the slider can be manually brought into a position in order to transfer the circuit breaker into a conductive state. By way of example, the slider, which is made from an electrically insulating material, is spring-loaded and, owing to the spring force, is moved between the contacts of the circuit breaker when the contacts are opening, with the result that an electrical short circuit of the two contacts is not possible without prior manual removal of the slider.

For this purpose, the circuit breaker particularly preferably has a manual trigger which projects out of the housing. By use of the manual trigger, it is made possible to bring the slider into the original position and thus to produce a conductive state of the circuit breaker. Preferably, in this operating step, electrical contact is also made between the two contacts of the circuit breaker. Alternatively to or in combination with this, provision is made to open the contacts of the circuit breaker by the manual trigger and thus to interrupt a flow of current through the circuit breaker. In other words, the circuit breaker, in particular the manual trigger, makes it possible to open or close the circuit in the manner of a conventional switch. In this way, it is made possible to interrupt the circuit by the circuit breaker in order to perform any repair work or maintenance work which relates to the circuit.

Alternatively to or in combination with the reversible tripping, the circuit breaker has the option of being adjusted in order to modify the responsiveness thereof. In this connection, either the current which leads to the tripping and/or the electric voltage are/is adjusted or the reaction time necessary for tripping is modified. In other words, by adjusting the trip characteristics of the circuit breaker, it is determined whether, for example, either a quick-acting fuse or a time-delay fuse is emulated.

By way of example, the circuit breaker contains a stationary contact and a bimetal element, each of which is electrically connected to one of the connection points. Furthermore, the circuit breaker has a displaceable contact which is arranged on the bimetal and, in the conductive state, is in electrically conductive contact with the stationary contact. When the bimetal element heats up, it is deformed and the displaceable contact is moved away from the stationary contact. In this connection, the bimetal element is configured, for example geometrically and/or by material selection, such that, below a threshold value which leads to tripping, the displaceable contact is in abutment with the stationary contact and thus a flow of current is made possible via said two contacts. If the threshold value, which in particular indicates a current value or voltage value, is exceeded, the bimetal element bends such that the two contacts are separated from one another.

As an alternative to this, a contact carrier which bears the displaceable contact is provided. In the conductive state, the contact carrier is latched to the bimetal element and an electrical connection is produced between the displaceable contact and the stationary contact. When the threshold value is exceeded, the latching between the bimetal element and the contact carrier is lifted, with the result that the electrically conductive connection between the displaceable contact and the stationary contact is lifted. For this purpose, by way of example, the contact carrier is spring-loaded and/or is held in the desired position by a latching lug of the bimetal element in the conductive state. Preferably, the contact carrier is pivotable and is pivoted in the event of a transfer from the conductive into the non-conductive state, which has a comparatively low requirement on space. A circuit breaker such as this is preferably used instead of a time-delay blowable fuse.

In another embodiment of the invention, the circuit breaker contains a magnetic trigger, wherein this embodiment is preferably used in order to replace quick-acting blowable fuses. The magnetic trigger has, in particular, an electrical coil for generating a magnetic field. In a suitable manner, a contact spring is connected in series with the coil, which contact spring acts as a type of switch, for example. Preferably, the contact spring is spring-loaded, for example by a coil spring or the use of a spring steel to produce the contact spring, and/or the contact spring is operatively connected to the magnetic field generated by the coil. When the magnetic field changes, the contact spring is moved and electrical contact between the two connection points of the circuit breaker is interrupted. In particular, in the conductive state, the current flows through the contact spring and the electrical coil. When the circuit breaker is tripped, electrical contact produced via the contact spring is interrupted in this case, which leads to interruption of the flow of current within the coil and thus to a collapse of the magnetic field.

Another embodiment of the invention provides that a contact spring is used for current interruption, which contact spring is mechanically pre-tensioned in the contact state, that is to say when the circuit breaker is conductive. This is done, for example, by a separate spring or by the production of the contact spring itself, for example from spring steel. The pre-tensioning is in this case such that the contact spring moves from the contact position into an open position. In other words, by the pre-tensioning, the circuit is caused to open. In order to keep the contact spring in the conductive position, a thermal trigger element is provided, which keeps the contact spring in the contact position despite the pre-tensioning. The thermal trigger element is in this case, in particular, an expansion wire, that is to say a wire the longitudinal extent of which is dependent on the temperature of said wire. The electric current itself preferably flows through the thermal trigger element. In the event of an increased flow of current, the temperature of the thermal trigger element itself is thus increased and, as a result of this, the opposing force applied by the thermal trigger element and acting counter to the pre-tensioning is not sufficient in order to keep the contact spring in the contact position. A configuration such as this of the circuit breaker is preferably used as a replacement for a medium blowable fuse.

Another embodiment of the invention provides for connecting the circuit breaker to the mounting for G fuse-links by an adaptor. For this purpose, the adaptor has two connection points which are cylindrical and, in particular, identical. In this case, the axes of the respective connection points are on a common axis. In other words, the center points of the cross sections of the two connection points overlap perpendicular to the axis thereof, wherein the cross sections are preferably parallel to one another. In particular, the cross sections mutually overlap. The cross sections themselves are advantageously substantially round. At least the external diameter is between 5.0 mm and 5.3 mm, wherein one stretch along the axis limited by the two connection points is between 19.0 mm and 21.0 mm. Particularly preferably, the external diameter of each of the connection points is precisely 5.2 mm, wherein a respective upward and downward tolerance of 0.1 mm and 0.2 mm is accepted. Advantageously, the maximum distance is precisely 20.0 mm with a tolerance of 0.5 mm.

As an alternative to this, the external diameter is precisely 6.2 mm, 6.5 mm or any value between the two values. In this embodiment, the maximum distance between the connection points is 30.5 mm to 33.0 mm. Particularly preferably, the external diameter is precisely 6.35 mm with a tolerance of 0.1 mm and the maximum distance is 31.8 mm, wherein a deviation of up to 0.8 mm is accepted.

The adaptor also has a receiving connector which is provided and set up to make electrical contact with a circuit breaker. For this purpose, each of the connection points, which are preferably made from an electrically conductive material or at least comprise same, is electrically conductively connected to in each case one receiving region of the receiving connector. In this case, the receiving connector comtains at least two receiving regions for making electrical contact with the circuit breaker, wherein the connection points and the receiving points are electrically conductively connectable only by the circuit breaker. By way of example, the receiving connector contains further elements for mechanical stabilization of the circuit breaker, for instance latching lugs, screws or the like. Expediently, the receiving connector meets at least one standard for circuit breakers.

The adaptor enables the integration of a conventional circuit breaker for the purpose of protection in already existing circuits protected by a G fuse-link. No structural modifications to the circuit or any components thereof, for example a printed circuit board, need to be made for this purpose. Furthermore, it is not necessary to keep G fuse-links in stock in order to transfer the protected circuit into a conductive state once more after overloading and associated disconnection. Furthermore, it is made possible to use a multiplicity of different circuit breakers to protect the circuit, and thus to adapt the protection to current requirements. In addition, what is made possible with a suitable selection of the circuit breaker is the use of a comparatively sharp characteristic curve to protect the circuit. Consequently, the number of erroneous disconnections is reduced but, at the same time, the protective effect is increased.

Expediently, the height of each of the cylindrical connection points, that is to say the extent along the respective axis, is between 4.0 mm and 6.0 mm, provided that the connection points have the smaller of the two external diameters. As a result of this, the minimum distance between the two connection points is between 7.0 mm and 13.0 mm, in particular 21.0 mm minus two times 4.0 mm or 19.0 mm minus two-times 6.0 mm. As an alternative to this, the height of the two connection points is between 5.5 mm and 7.0 mm if the larger of the two is selected as the external diameter. Particularly preferably, the height is precisely 5.1 mm with a deviation of up to 0.6 mm, or 6.2 mm likewise with a tolerance of up to 0.6 mm. Owing to a selection such as this of the dimensions, the adaptor thus fulfils the requirements of European Standard EN 60127 for G fuse-links.

The receiving connector is preferably configured to receive two tabs of the circuit breaker. In other words, the two receiving points are preferably formed in the manner of a slot into which the tabs of the circuit breaker are inserted for the purpose of mounting the circuit breaker. By way of example, in this connection, the two slots are aligned substantially parallel to the common axis of the connection points, at least the tabs of the circuit breaker in the state mounted on the adaptor. Owing to such a design of the receiving connector, the radial extent of the adaptor, that is to say the extent thereof perpendicular to the axis of the connection points, is reduced. In this way, it is made possible to replace even G fuse-links which are comparatively close to one another by the adaptor and a suitable circuit breaker.

Other features which are considered as characteristic for the invention are set forth in the appended claims.

Although the invention is illustrated and described herein as embodied in a circuit breaker and an adapter for a circuit breaker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 2-5 are diagrammatic, perspectives view of further embodiments of the circuit breaker; and FIG. 6 is a perspective view of an adaptor for the circuit breaker.

DETAILED DESCRIPTION OF THE INVENTION

Figure 1A:
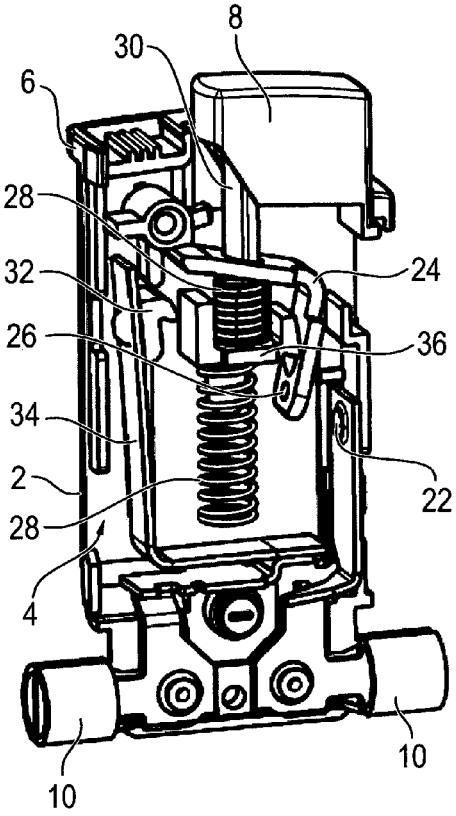
FIGS. 1A and 1B are diagrammatic, perspective views of a first embodiment of a circuit breaker according to the invention.

Parts which correspond to one another are provided with identical reference signs in all of the figures. Referring now to the figures of the drawings in detail and first, particularly to FIGS. 1A and 1B thereof, there is shown a first embodiment of a circuit breaker 2 in a perspective view, wherein, in FIG. 1A, a part of a housing 6 which covers a region of a breaker latching mechanism 4 is removed. The circuit breaker 2 is used to protect a circuit in the mounted state, in particular electrical lines and/or consumers, for instance of an electric motor, against an overvoltage and/or an over current. A manual trigger 8 projects out of one side of the housing 6, by which manual trigger the breaker latching mechanism 4 is actuable. On the side of the housing 6 which is opposite to the manual trigger 8, there are two hollow-cylindrical connection points 10 which are produced from a bent metal strip. In other words, the connection points 10 are stamped and bent parts, wherein the cross section of each of the connection points 10 is configured to be substantially S-shaped. In this connection, the cross section is perpendicular to an axis 12 on which the two connection points 10 lie.

The maximum distance 14 between the two connection points 10 is in this case either 20.0 mm or 31.8 mm. The minimum distance 16, which is limited by the two limit surfaces which face towards one another of the two connection points 10, is precisely 9.8 mm or 19.4 mm. Consequently, a height (length) 18, that is to say the extent of the respective connection point 10 along the axis 12, is either 5.1 mm or 6.2 mm, wherein the height 18 of the two connection points 10 is identical.

An external diameter 20 of the two connection points 10 is either precisely 5.2 mm or 6.35 mm. In this case, for the connection points 10, the respectively smaller values for the maximum distance 14, the height 18 and the external diameter 20 are always used. Thus, each of the connection points 10 has a height 18 of 5.1 mm and an external diameter 20 of 5.2 mm, wherein the maximum distance 14 is substantially 20.0 mm, or, alternatively to this, the height 18 is precisely 6.2 mm, the external diameter 20 is precisely a value of 6.35 mm and the maximum distance 14 is 31.8 mm.

The metal strip forming one of the two connection points 10 transitions into a stationary contact 22 opposite which a displaceable contact 26 arranged on a contact carrier 24 is pivotably mounted. In this connection, the substantially L-shaped contact carrier 24 has force applied thereto by two springs 28 and is guided by a guide stack 30 formed on the manual trigger 8. In the conductive state, the free end of the contact carrier 24 which is opposite the displaceable contact 26 is engaged with a latching lug 32 which is formed on a bimetal element 34. The bimetal 34 itself is in electrical contact with the remaining one of the two connection points 10.

By means of a movement of the manual trigger 8 in the direction of the connection point 10, the circuit breaker 2 is brought from the non-conductive state—illustrated here—into a conductive state in which a carrier 36 formed on the guide rod 30 presses the displaceable contact 26 against the stationary contact 22 counter to the force applied by the two springs 28 and thus electrically conductively connects the two contacts 22, 26. In this position, the bimetal element 34 latches via the latching lug 32 with the contact carrier 24 and keeps the contact carrier 24 in precisely this position.

In the event of an over current and subsequent heating of the bimetal element 34, the free end thereof which bears the latching lug 32 is pivoted away from the contact carrier 24, which releases same. Owing to the force provided by the springs 28, the now-released free end of the contact carrier 24 is pivoted in the direction of the manual trigger 8, which lifts the electrical contact between the displaceable contact 24 and the stationary contact 22 and thus interrupts a flow of current via the two connection points 10 through the breaker latching mechanism 4. This type of circuit breaker 2 is used as a replacement for a conventional time-delay G fuse-link.

Figure 1B:
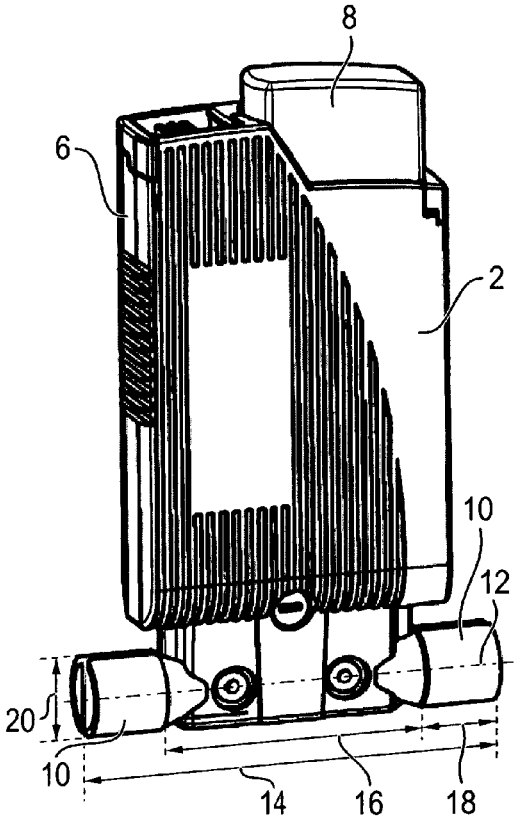
Figure 2:
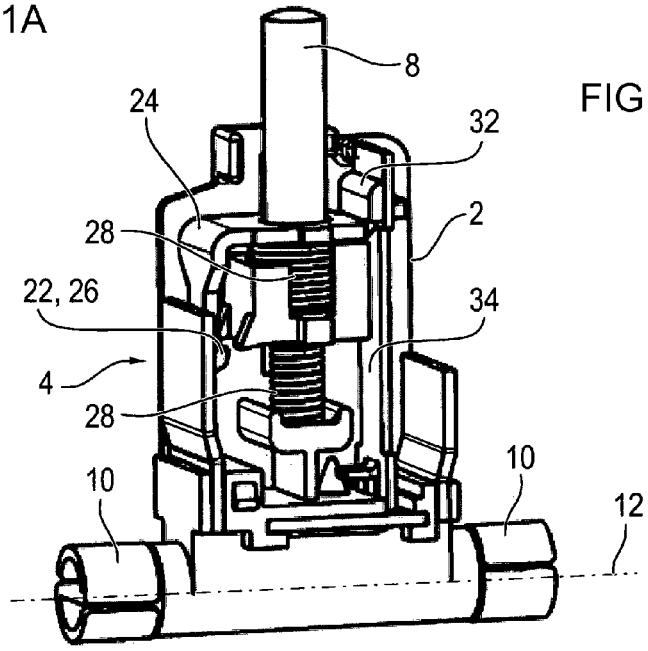

FIG. 2 shows a perspective illustration of another embodiment of the circuit breaker 2 according to FIG. 1A. The function and configuration of the breaker latching mechanism 4 substantially corresponds to the preceding embodiment of the circuit breaker 2, wherein the breaker latching mechanism 4 is shown in the conductive state. In other words, the contact carrier 34 is held by the latching lug 32 of the bimetal element 34 counter to the force applied by the springs 28. For this reason, the stationary contact 22 and the displaceable contact 26 are in electrically conductive contact with one another. In contrast, what is different is the configuration of the manual trigger 8 the shape of which is substantially that of a round cylinder. The connection points 10 are also rotated by 90° about the axis 12 in comparison to the first embodiment.

Figure 3A:
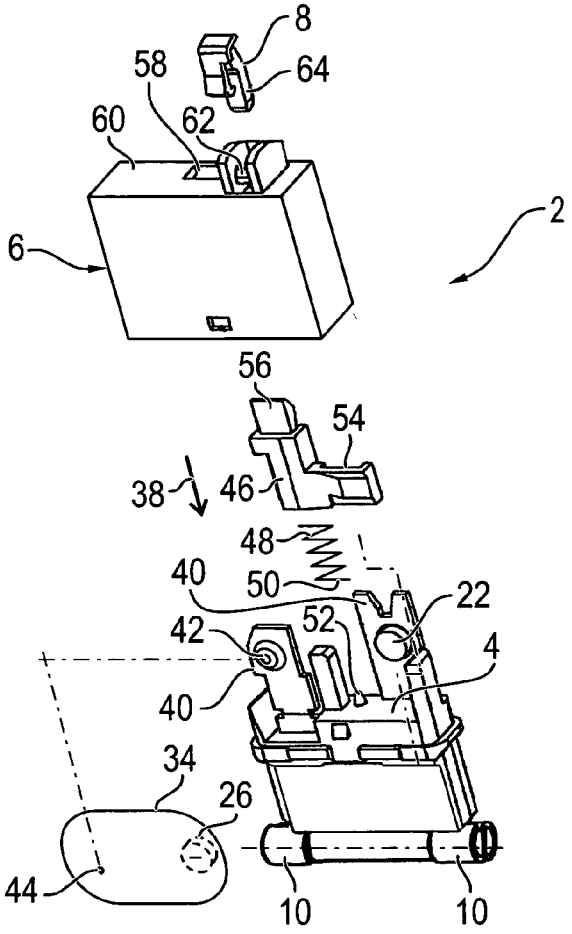

FIG. 3A shows another configuration of the circuit breaker 2 in an exploded illustration, wherein the components of the circuit breaker 2 are removed from the connection points 10 counter to a joining direction 38, which connection points 10 substantially correspond to those of the preceding embodiments of the circuit breaker 2. The breaker latching mechanism 4 has two receiving carriers 40 which are manufactured as stamped and bent parts in one piece with in each case one of the connection points 10. One of the receiving carriers 40 in this case bears the stationary contact 22 and the other bears a connection point 42 to which the bimetal element 34, which bears the displaceable contact 26, is welded in the mounted state at a welding point 44.

The breaker latching mechanism 4 also contains a slider 46 to which force is applied by a spring 48. The free end 50 of the spring 48 which is remote from the slider 46 is held in a manner fixed in place by a fastening lug 52 within the housing 6. The slider 46 has an interruption region 54 and an indicating region 56 which projects through an aperture 58 of the housing cover 60 if the interruption region 54 is located between the displaceable contact 26 and the stationary contact 22. When the bimetal 24 heats up, the displaceable contact 26 in particular is removed from the stationary contact 22 on account of the forces acting within the bimetal element 24, with the result that the interruption region 54 of the slider 46 is introduced between the two contacts owing to the spring force acting on it. When the bimetal element 34 cools down once more, the displaceable contact 26 is kept at a distance from the stationary contact 22 owing to the slider 46, as a result of which a flow of current from one of the connection points 10 to the other is suppressed in this case, too. Only when the indicating region 56 is manually moved in the joining direction 38 is the interruption region 54 between the two contacts 22, 26 removed and the bimetal 34 snaps into a conductive position. In this case, the force applied by the bimetal element 34 is comparatively large and the configuration of the interruption region 54 is such that, despite the spring force, the electrical contact between the stationary contact 22 and the displaceable contact 26 is maintained.

The manual trigger 8 is configured to be substantially U-shaped and, in the mounted state, is latched with a fastening spring 62. The manual trigger 8 contains a trigger limb 64 by which the bimetal element 34 can be moved away from the stationary contact 22 in the event of a pivoting movement of the manual trigger 8 about the fastening spring 62. Owing to the slider 46 snapping into the gap, it is thus possible to suppress an electrical connection between the two connection points 10 by the manual trigger 8, although no disturbing case is present.

Figure 3B:
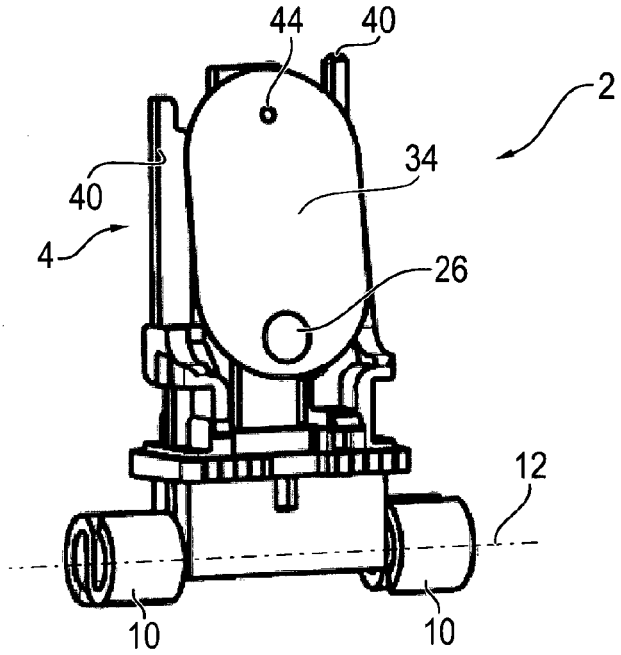

The alternative shown in FIG. 3B of the circuit breaker 2 corresponds substantially to the preceding embodiment. In contrast, the slider 46 is omitted and the bimetal element 34 is oriented in the joining direction 38. As a result of this, the extent of the breaker latching mechanism 4 along the axis 12 is reduced; as a result of which the circuit breaker 2 can also be used in comparatively narrow fuse boxes.

FIG. 4 shows another embodiment of the circuit breaker 2 which is used as a replacement for a quick-acting blowable fuse. The breaker latching mechanism 4 has a magnetic trigger 66 with a coil 68 one end of which is directly connected to one of the receiving carriers 40 and the other electrical end of which is connected via a contact spring 70 to the remaining one of the two receiving carriers 40, which in each case are in electrical contact with one of the connection points 10. The connection points 10 are in this case again in one piece with the respectively associated receiving carrier 40.

The coil 68 is looped around a damping element modified by an adjustment screw 72, by which damping element the trip characteristics of the circuit breaker 2 are modifiable. Furthermore, a permanent magnet 74 is arranged within the coil 68 and is in contact with two conductor limbs 76 which are parallel to one another and made of soft iron and with which the coil 68 is also in abutment. The two conductor limbs 76 are arranged perpendicular to the coil 68 and bridged by a yoke 78, which is held in contact with the conductor limbs 76 counter to a force exerted by a spring 80, owing to the magnetic force applied by the permanent magnet 74. On the side of the yoke 78 which is opposite the spring 80, the contact spring 70 is arranged and is positioned there by the manual trigger 8.

In the case of a flow of current via the circuit breaker 2, a magnetic field is generated by the electrical coil 68, which magnetic field is set up in opposition to the magnetic field of the permanent magnet 74. Owing to this, the force holding the yoke 78 in contact with the conductor limbs 76 is reduced. If the flow of current through the coil 68 exceeds a particular limit value, the magnetic force acting on the yoke 78 is smaller than the spring force and the yoke 78 is removed from the conductor limbs 76, wherein the contact spring 70 is taken away from the yoke 78. As a result of this, the electrical contact between the contact spring 70 and the associated receiving carrier 40, and the electrical connection to the coil 68, are removed and thus the flow of current through the circuit breaker 2 is interrupted.

FIG. 5 shows a final embodiment of the circuit breaker 2 according to FIG. 1A, wherein once again in each case a receiving carrier 40 and a connection point 10 are produced in one piece with one another as stamped and bent parts. The substantially U-shaped contact spring 68 is attached, preferably welded, to one of the two receiving carriers 40. The remote free end of the contact spring 68 bears the displaceable contact 26, which, in the conductive state, is in abutment with the stationary contact 22 formed by the remaining receiving carrier 40. In the conductive state which is illustrated here, a current consequently flows from the one of the connection points via the associated receiving carrier, the contact spring 68, the displaceable contact 26 and the stationary contact 22 to the second receiving carrier 40 and the connection point 10 which is in one piece with the second receiving carrier.

The contact spring 68 is pre-tensioned in the opening direction. In other words, the contact spring 68 is manufactured and/or fastened to the receiving carrier 40 such that a force which is directed away from the stationary contact 22 acts on the displaceable contact 26. The two contacts 22, 26 are held against the force by an expansion wire 82 the length and/or elasticity of which is dependent on its temperature. In the event of an increased flow of current, the temperature of the expansion wire 82, through which the electric current also flows, increases. As a result of this, the length of the expansion wire 82 is increased and the contact spring 68 snaps away from the stationary contact 22 into a rest position. In this case, the contact spring 68 has a curvature which is directed counter to the illustrated curvature. Owing to the arrangement of the expansion wire 82 between the two U-shaped limbs of the contact spring 68, the displaceable contact 26 is thus moved further away from the stationary contact 22 in the event of the expansion wire 82 cooling down. The circuit breaker 2 can be brought into the conductive state again only by the manual trigger 8. This type of circuit breaker 2 is used as a substitute for a medium blowable fuse.

FIG. 6 shows an adaptor 84 for receiving a circuit breaker 2. The adaptor 84 has the two connection points 10 which are arranged on the axis 12 and are in turn manufactured from a bent metal strip. The configuration of the connection points 10 themselves corresponds to that of the connection points 10 of the circuit breaker 2 of the preceding figures. Thus, the height 18 is either precisely 5.1 mm or 6.2 mm, the external diameter 20 is precisely 5.2 mm or 6.35 mm and the maximum distance 14 between the two connection points 10 is precisely 20.0 mm or 31.8 mm. As a result of this, it is made possible to electrically conductively position the adaptor 84 in a receiver of a G fuse-link which is defined in European Standard EN 60127.

The adaptor 84 has a receiving connector 86 having two receiving points 88. Each of the receiving points 88 makes electrical contact with in each case one of the connection points 10 and is configured to receive a tab 90 of a circuit breaker 2. In this case, in the mounted state, in each case one of the tabs 90 of the circuit breaker 2 makes electrical contact with one of the connection points 10 via the respective receiving point 88. In this way, it is made possible to combine a multiplicity of different circuit breakers 2 with the adaptor 84 and thus to adjust the protection of the circuit to the requirements prevailing therein. The profile of the tabs 90 is parallel to the axis 12, as a result of which the requirement on space of the assembly of the circuit breaker 2 under the adaptor 84 is comparatively space-saving.

The invention is not restricted to the above-described exemplary embodiments. Rather, other variants of the invention can also be derived herefrom by a person skilled in the art without departing from the subject matter of the invention. In particular, all individual features described in connection with the exemplary embodiments can also be combined with one another in other ways without departing from the subject matter of the invention.

The following is a summary list of reference numerals and the corresponding structure used in the above description of the invention. List of reference signs:

2 circuit breaker
4 breaker latching mechanism
6 housing
8 manual trigger
10 connection point
12 axis
14 maximum distance
16 minimum distance
18 height
20 external diameter
22 stationary contact
24 contact carrier
26 displaceable contact
28 spring
30 guide rod
32 latching lug
34 bimetal element
36 carrier
38 joining direction
40 receiving carrier
42 connection point
44 welding point
46 slider
48 spring
50 free end
52 fastening lug
54 interruption region
56 indicating region
58 aperture
60 cover
62 fastening spring
64 trigger limb

66 magnetic trigger
68 coil
70 contact spring
72 adjustment screw
74 permanent magnet
76 conductor limb
78 yoke
80 spring
82 expansion wire
84 adaptor
86 receiving connector
88 receiving points
90 tab

The invention claimed is:

1. A circuit breaker for protecting a circuit, comprising:
a housing;
two electrically conductive, substantially cylindrical connection points disposed along an axis, wherein said connection points having either:
an external diameter being between 5.0 mm and 5.3 mm and a maximum distance between said connection points being between 19.0 mm and 21.0 mm; or
said external diameter being between 6.2 mm and 6.5 mm and said maximum distance between said connection points is between 30.5 mm and 33.0 mm;
a breaker latching mechanism, containing:
a stationary contact being electrically connected to a first of said connection points;
a displaceable contact;
wherein in an electrically conductive state of said breaker latching mechanism, said stationary contact being electrically connected to a second of said connection points by said displaceable contact;
wherein in an electrically non-conductive state of said breaker latching mechanism, said displaceable contact being reversibly lifted off said stationary contact thereby interrupting a flow of current via said first and second connection points through said breaker latching mechanism; and
a spring biasing said breaker latching mechanism to the electrically non-conductive state and a spring force of said spring may be overcome for returning said breaker latching mechanism from the electrically non-conductive state to the electrically conductive state.

2. The circuit breaker according to claim 1, wherein said connection points having a height in each case of between 4.0 mm and 6.0 mm or between 5.5 mm and 7.0 mm, and/or said connection points are made from a metal strip with a substantially S-shaped cross section.

3. The circuit breaker according to claim 1, further comprising a manually actuable slider and for reversible tripping, a transfer from the electrically non-conductive state to the electrically conductive state is blocked by said manually actuable slider.

4. The circuit breaker according to claim 3, further comprising:
a bimetal element;
a contact carrier, said stationary contact being electrically connected to said second of said connection points by said displaceable contact and said bimetal element; and
said bimetal element having a latching lug by which said contact carrier which bears said displaceable contact and is pivotable with respect to said stationary contact is latched in the electrically conductive state.

5. The circuit breaker according to claim 1, further comprising a manual trigger projecting out of said housing.

6. The circuit breaker according to claim 1, further comprising;
a bimetal element, said stationary contact being electrically connected to said second of said connection points by said displaceable contact and said bimetal element, wherein said displaceable contact is disposed on said bimetal element.

7. The circuit breaker according to claim 1, further comprising a magnetic trigger having a coil, said is connected in series with said coil of said magnetic trigger in the electrically conductive state.

8. The circuit breaker according to claim 1, further comprising a thermal trigger element, said spring being mechanically pre-tensioned in an aperture direction and is held in a contact-making position by said thermal trigger element in the electrically conductive state.

9. The circuit breaker according to claim 8, wherein said thermal trigger element is an expansion wire.

* * * * *